US011383739B2

(12) United States Patent
Nicole

(10) Patent No.: US 11,383,739 B2
(45) Date of Patent: Jul. 12, 2022

(54) SEAL RETENTION DEVICE

(71) Applicant: Westinghouse Air Brake Technologies Corporation, Wilmerding, PA (US)

(72) Inventor: Martin Nicole, Blainville (CA)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 419 days.

(21) Appl. No.: 16/233,843

(22) Filed: Dec. 27, 2018

(65) Prior Publication Data

US 2020/0207379 A1 Jul. 2, 2020

(51) Int. Cl.
*B61D 19/00* (2006.01)

(52) U.S. Cl.
CPC ..... *B61D 19/005* (2013.01)

(58) Field of Classification Search
None
See application file for complete search history.

(56) References Cited

U.S. PATENT DOCUMENTS 2,152,590 A * 3/1939 Hall ..... B60J 10/36 411/520
4,051,336 A * 9/1977 Miller ..... B60J 10/00 200/61.43
6,966,601 B2 * 11/2005 Matsumoto ..... B60R 13/0206 296/146.2
7,536,830 B2 * 5/2009 Clark ..... B60J 10/32 296/146.7
2014/0137480 A1 * 5/2014 Sato ..... B60J 5/0402 49/406
2017/0305247 A1 * 10/2017 Salles ..... B61D 19/00
2019/0061503 A1 * 2/2019 Filipczak ..... B60J 10/15
2019/0093422 A1 * 3/2019 Ritt ..... E06B 3/7015
2019/0255923 A1 * 8/2019 Salles ..... B61D 19/026

FOREIGN PATENT DOCUMENTS

DE 10044071 A1 4/2002
EP 1575068 A2 9/2005
EP 2689949 A1 1/2014
WO 2016030611 A1 3/2016

* cited by examiner

*Primary Examiner* — Catherine A Kelly
(74) *Attorney, Agent, or Firm* — The Small Patent Law Group LLC; John P. Darling

(57) ABSTRACT

A sealing system for an openable panel on a vehicle includes a channel member disposed on the openable panel and extending along a longitudinal axis and a seal member fastened to the channel member. The channel member includes two side portions extending parallel to each other and a recess defined between the two side portions. A plurality of depressions are defined in the side portions and extend along the longitudinal axis and into the recess. The seal member includes a proximal portion disposed within the recess and a distal portion extending away from the channel member. The proximal portion of the seal member has grooves defined on opposing sides thereof. The plurality of depressions on each side portion of the channel are received in a respective groove on the seal member to fasten the seal member to the channel member.

20 Claims, 6 Drawing Sheets

SEAL RETENTION DEVICE

BACKGROUND OF THE INVENTION

Field of the Invention

The present invention relates generally to sealing assemblies on door panels for transit vehicles, such as subway and commuter railcars. More particularly, the present invention relates to a sealing assembly in which a sealing member is assembled within a C-shaped channel member.

Description of Related Art

Several designs of transit door panels fitted with rubber edge seals have been described in the prior art and utilized on transit railcars. In several of these designs, the door panel structure is made from extruded profiles, most frequently aluminum profiles. The extruded profile easily lends itself to providing a continuous built-in retention feature for the rubber seal member. One example of such a built-in retention feature for the rubber seal member applied to the extruded profile is disclosed in United States Patent Application Publication No. 2017/0305247, which is hereby incorporated by reference in its entirety.

A prior art example of a retention feature applied to channel members is shown in FIG. 1. When stock stainless steel C-shaped channel members are used as structural members of the panel, a different method must be used to create the retention feature on the channel members. The retention feature is implemented in this example by bending the edges of wings of the C-shaped channel member toward the inside of the C-shaped channel member to form two retention hooks for retaining the seal member on the channel member. This method, while inexpensive to manufacture, does not provide optimum results because it is difficult to obtain consistent and accurate bending angles and lengths of the wings. Moreover, the wings do not entirely fill the mating groove of the rubber seal member. These drawbacks can cause a loose assembly of the seal member on the channel member, which allows the seal member to rock sideways, as illustrated in FIG. 1.

An alternative example of a retention feature is shown in FIG. 2. In this example, the rubber seal member is rigidly fastened to a second C-shaped channel member known as a seal carrier. The seal carrier has slots on its side disposed at an angle with respect to its length. These slots mate with pins disposed in the first C-shaped channel member that is part of the door panel structure, so that the seal carrier/rubber seal member assembly is hung on the door panel edge. This solution provides good seal retention but has the disadvantage of adding to the overall weight of and cost of the door panel, including substantial additional labor for assembly, due to the need for the additional seal carrier and pins inserted into the first C-shaped channel member on the door panel edge. The cost of the seal carrier is also increased when the door panel profile is curved.

SUMMARY OF THE INVENTION

According to an example of the present disclosure, a rubber edge seal retention device is provided that features both cost-effectiveness and repeatable and excellent retention performance for transit door panels using a stainless steel C-channel structure. The device adds little to no extra weight to the door panel. The device requires only one C-shaped channel member. Instead of bending the C-shaped channel member to create retention wings and hooks, as described above, a punch and die is used to create depressions in the C-shaped channel member. Each depression is a few inches long and spaced apart by a few inches. The width of the depression is adjusted to be substantially the same as the width of the mating groove of the rubber seal member. The punch and die manufacturing process is inexpensive, highly repetitive, and achieves good manufacturing tolerances. The rubber seal member may be removed for maintenance purposes. The device provides sufficient retention on the rubber seal member to preclude ridership vandalism, while being easily installed. The device may be installed on stainless steel structure door panels used on railcar transit and commuter vehicles.

According to an embodiment of the present disclosure, a rubber edge seal retention device is provided. The device includes a rubber seal made up of a front section and a back section. The back section has a wedge and two rectangular retention grooves having a depth and a width disposed on each side of the wedge. The device also includes a metallic C-channel made up of first and a second wings, the wings being substantially parallel, and a section joining the parallel wings. The C-channel has depressions disposed on both the first and the second wing of the channel along its long axis with the depressions on the first wing substantially facing the depressions on the second wing. The depressions are created using a punch and die tool or alternate method of producing the same with substantially similar accuracy. Each depression is made of one straight section parallel to its associated wing and located substantially away from its associated wing and toward its opposite wing so as to define the depth of the depression, and two curved sections joining the straight section with its associated wing. The straight and curved sections are obtained by making two cuts, both parallel to the edge of the C-channel and spaced apart by the width of the straight section and by plastic displacement of the material located between the two cuts. The depth and width of each depression is substantially same as the depth and width of the mating rubber seal retention groove. The C-channel may have adjacent depressions on the same wing or substantially spaced-apart depressions. The rubber seal may have a cavity disposed within the wedge cross section to facilitate insertion of the rubber seal into the C-channel.

According to a particular example of the present disclosure, a sealing system for an openable panel on a vehicle is provided. The sealing system comprises a channel member configured to be disposed on the openable panel and extending along a longitudinal axis. The channel member comprises at least two side portions extending substantially parallel to each other along the longitudinal axis and a recess defined between the at least two side portions. The at least two side portions each comprise a plurality of depressions defined therein extending along the longitudinal axis and into the recess of the channel member, the depressions arranged facing each other along the longitudinal axis. The system also comprises a seal member fastened to the channel member and extending along the longitudinal axis. The seal member comprises a proximal portion disposed within the recess of the channel member and a distal portion extending away from the channel member. The proximal portion of the seal member has grooves defined on opposing sides thereof extending along the longitudinal axis. The plurality of depressions on each side portion of the channel are received in a respective groove on the seal member to fasten the seal member to the channel member.

According to another particular example of the present disclosure, an openable panel for a vehicle is provided. The openable panel comprises a rigid panel configured to be movably connected to a vehicle wall in an opening defined in the vehicle wall, and a sealing system disposed on at least one side of the rigid panel. The sealing system comprises a channel member configured to be disposed on the openable panel and extending along a longitudinal axis. The channel member comprises at least two side portions extending substantially parallel to each other along the longitudinal axis and a recess defined between the at least two side portions. The at least two side portions each comprise a plurality of depressions defined therein extending along the longitudinal axis and into the recess of the channel member, the depressions arranged facing each other along the longitudinal axis. The system also comprises a seal member fastened to the channel member and extending along the longitudinal axis. The seal member comprises a proximal portion disposed within the recess of the channel member and a distal portion extending away from the channel member. The proximal portion of the seal member has grooves defined on opposing sides thereof extending along the longitudinal axis. The plurality of depressions on each side portion of the channel are received in a respective groove on the seal member to fasten the seal member to the channel member.

According to another particular example of the present disclosure, a method for assembling the above-described sealing system is provided. The method comprises providing the channel member, forming the plurality of depressions in the side portions of the channel member by punching inward the side portions of the channel member at a plurality of locations along the longitudinal axis, and inserting the proximal portion of the seal member into the recess of the channel member such that the plurality of depressions engages the grooves in the opposing sides of the seal member.

These and other features and characteristics of the present invention, as well as the methods of operation and functions of the related elements of structures and the combination of parts and economies of manufacture, will become more apparent upon consideration of the following description and with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular forms of "a", "an", and "the" include plural referents unless the context clearly dictates otherwise.

DETAILED DESCRIPTION OF THE INVENTION

Figure 1:
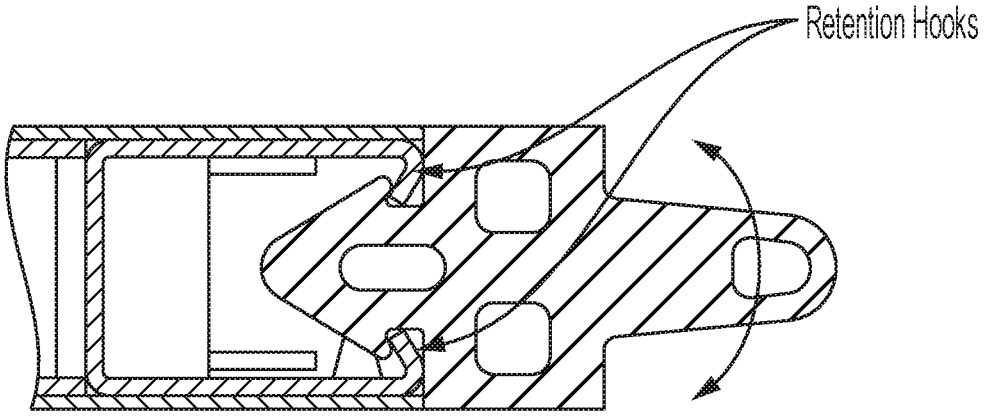
FIG. 1 PRIOR ART
FIG. 1 is a cross-sectional view of a retention mechanism for a door panel member according to a prior art example.
Figure 2:
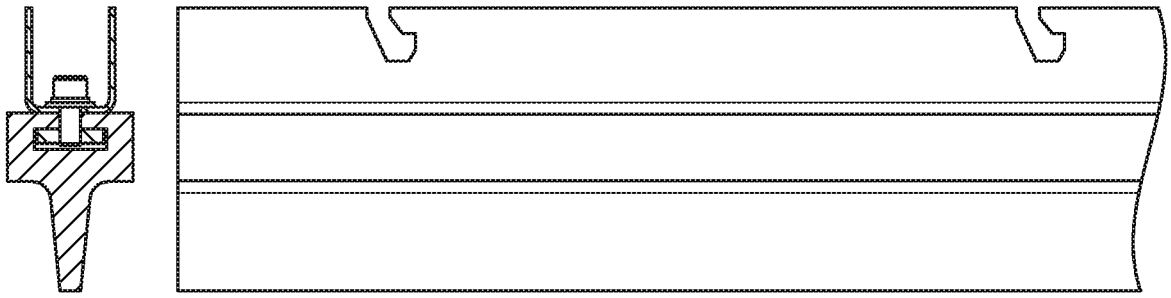
FIG. 2 PRIOR ART
FIG. 2 is a side view and cross-sectional view of a retention mechanism for a door panel seal member according to another prior art example.

For purposes of the description hereinafter, the terms "end", "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings and described in the following specification are simply exemplary embodiments or aspects of the invention. Hence, specific dimensions and other physical characteristics related to the embodiments or aspects disclosed herein are not to be considered as limiting.

Figure 3:
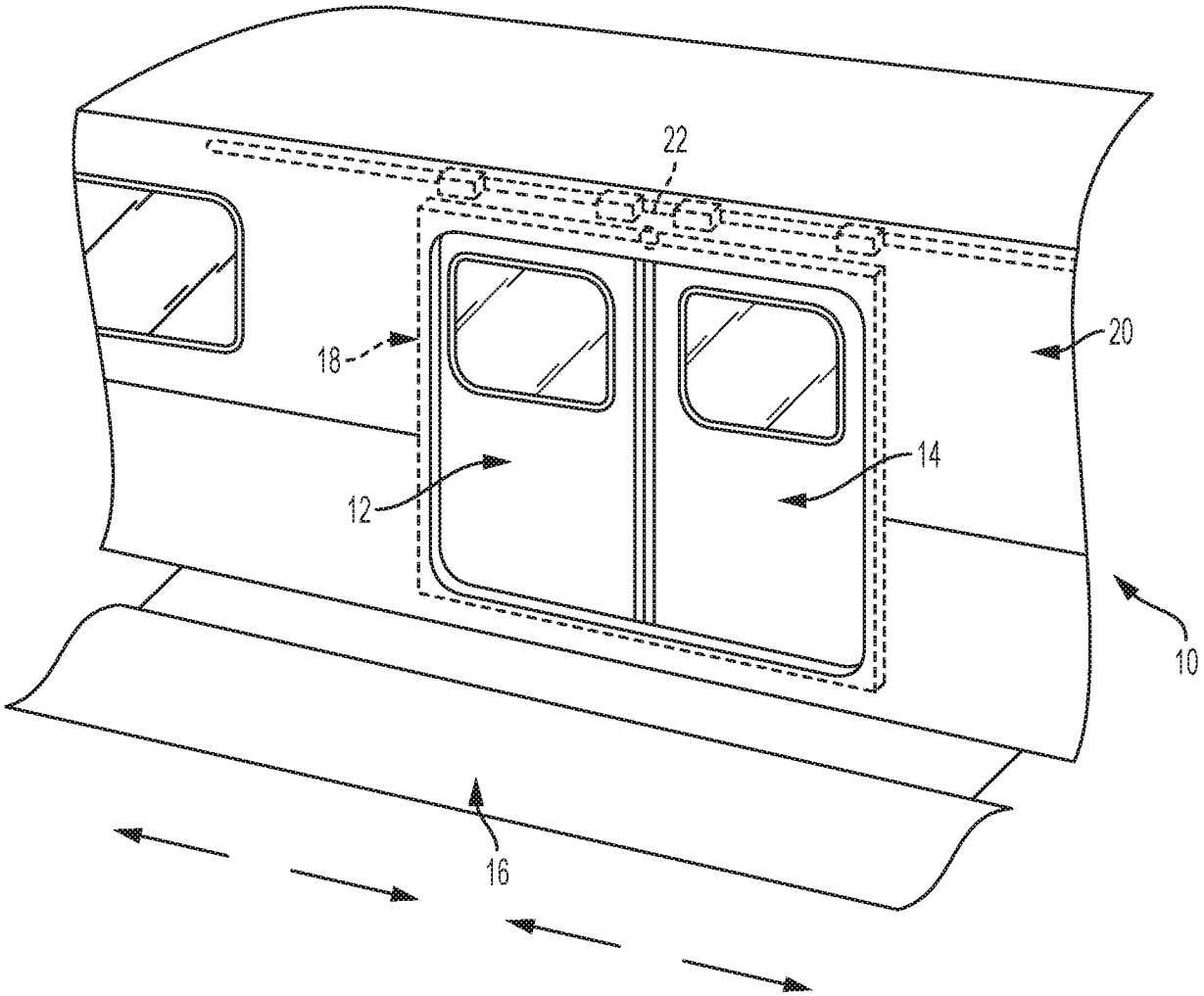
FIG. 3 is a perspective view of a portion of a transit vehicle having an openable door panel according to an example of the present disclosure.

With reference to FIG. 3, a transit vehicle 10, such as a subway car, trolley car, other rail transit vehicle, or similar vehicle, is shown according to an example of the present disclosure. The vehicle 10 includes a door assembly that includes a pair of outside bi-parting rigid openable panels or doors 12, 14 and a door operator system 22. As shown, the openable panels 12, 14 are closed and the transit vehicle 10 is stopped at a platform 16. The openable panels 12, 14 cover a passenger portal or opening 18 formed in a wall 20 of the transit vehicle 10. The openable panels 12, 14 are disposed adjacent to the wall 20 and are slidably suspended from the door operator system 22, which is disposed on the wall 20 above the door opening 18. The door operator system 22 moves the pair of openable panels 12, 14 in opposing directions along the door opening 18 between open and closed positions. According to another example of the present disclosure, only a single openable panel 12 may be provided to the opening 18. The door operator system 22 moves the single openable panel 12 between the open and closed positions.

With reference to FIGS. 4-9, one or both of the openable panels 12, 14 has a sealing system or rubber edge seal retention device according to an example of the present disclosure disposed on at least one side thereof for sealing an engagement between the openable panels 12, 14 and/or an engagement between one openable panel 12 and the wall 20 of the transit vehicle 10 and/or for sealing a gap between one or two openable panels and the wall 20 of the transit vehicle 10. Such a gap may be formed between the top of the openable panel 12, 14 and the wall 20 of the transit vehicle 10 or between the trailing edge of the openable panel 12, 14 and the wall 20 of the transit vehicle 10. It is to be appreciated that the openable panel, described below with reference to FIGS. 4-9, may be a window or other type of panel other than a door for entry and exit of passengers from the transit vehicle 10.

Figure 4:
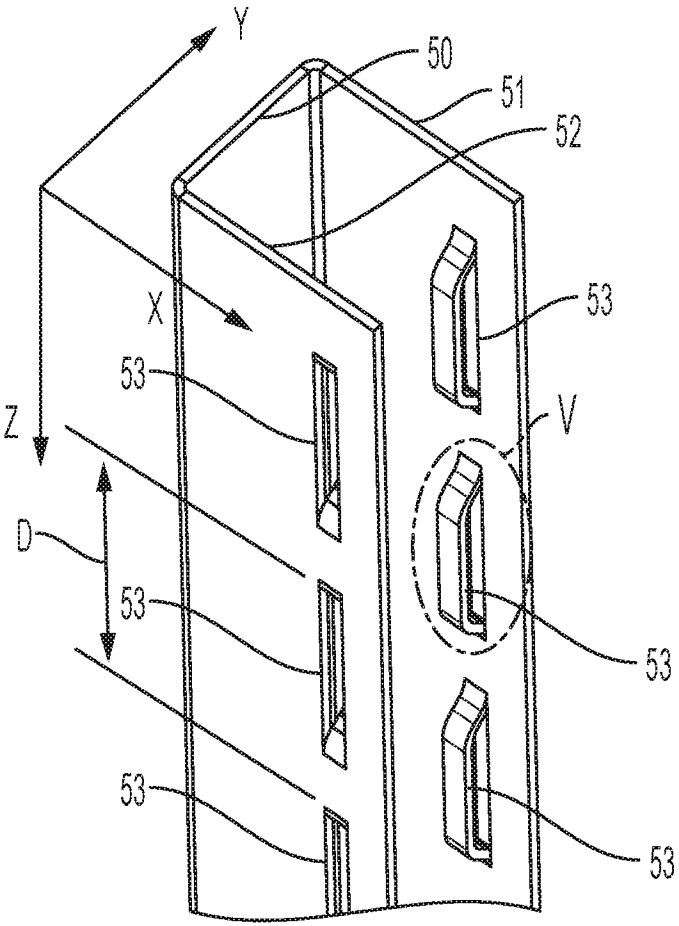
FIG. 4 is a perspective view of a channel member of a sealing system for an openable door panel according to an example of the present disclosure.

As shown in FIG. 4, the sealing system includes a metallic C-shaped channel member 50 where the two side portions or wings 51, 52 of the channel member 50 have been punched with depressions 53 extending over the whole length of the channel member 50. The channel member 50 is configured disposed on an openable panel, such as one of the openable door panels 12, 14 described above with reference to FIG. 3, and extends along a longitudinal direction or axis Z. The wings 51, 52 extend substantially parallel to each other along the longitudinal axis Z, and a recess is defined between the two wings 51, 52. Both wings 51, 52 include a plurality of the depressions 53 defined therein extending along the longitudinal axis Z and into the recess of the channel member 50. The depressions 53 are arranged facing each other or at least substantially facing each other along the longitudinal axis Z.

Figure 5:
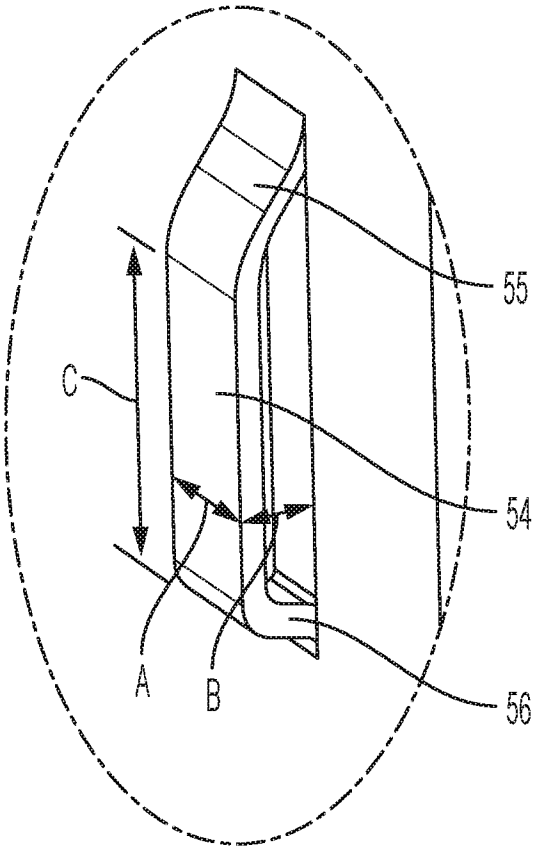
FIG. 5 is an enlarged perspective view of the channel member taken from area V shown in FIG. 4.

As shown in FIG. 5, which provides a detailed view of a single depression 53, each depression is formed by a straight rectangular section 54 joined to the respective wing 51 of the channel member 50 by two curved sections 55, 56 disposed at either end of the straight section 54. The straight section 54 has a width A and a length C and defines a depression depth B. As shown in FIG. 4, the plurality of depressions 53 in each wing 51, 52 have a repetition pitch D. The depressions 53 on one wing 51 of the channel member 50 are positioned to be substantially facing, i.e., level in the Z and X directions of FIG. 4, the depressions 53 in the other wing 52. This layout causes maximum retention force of the rubber seal member 60, which is pinched between the facing depressions 53, as shown in FIGS. 7-9.

Figure 6:
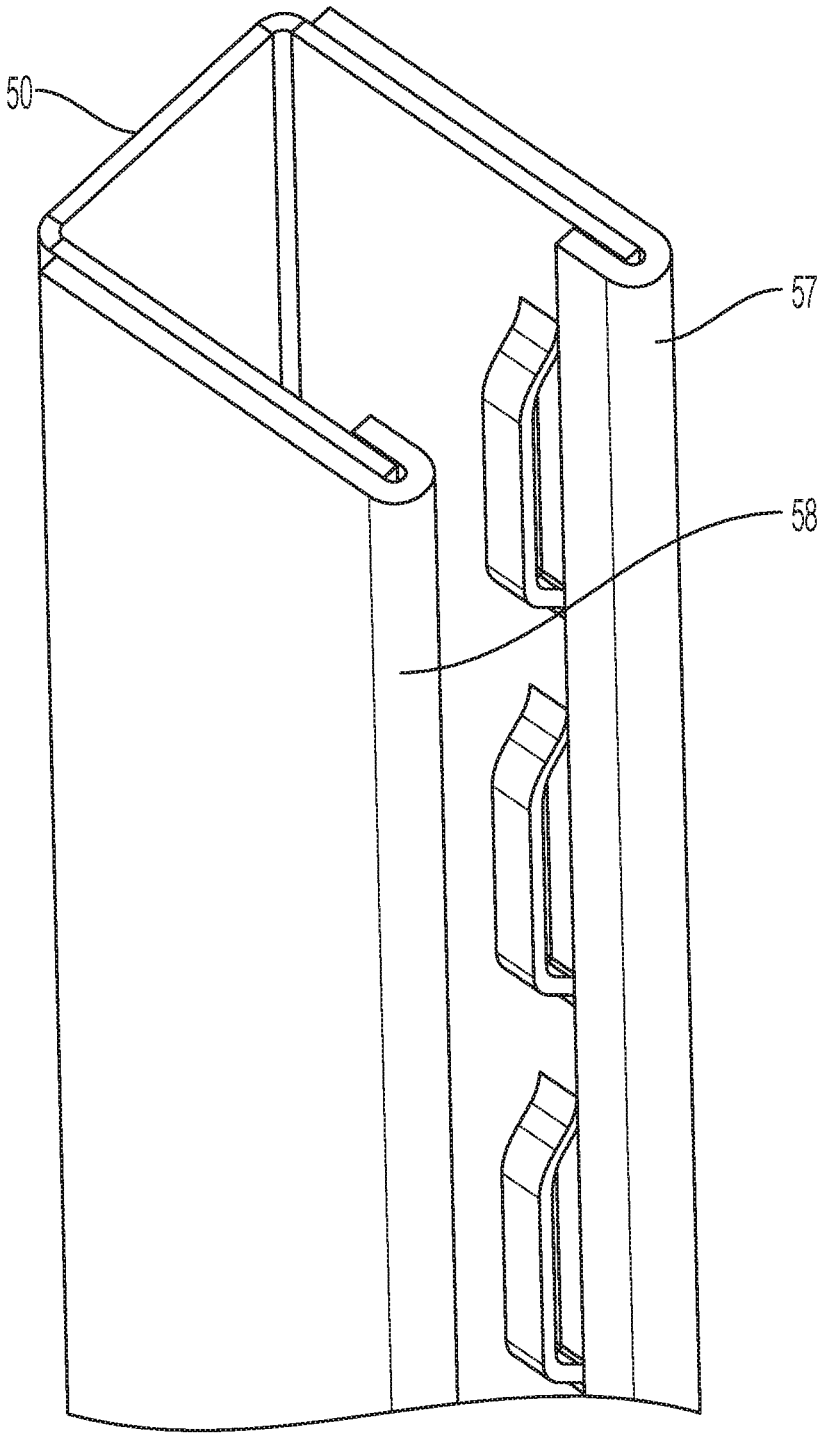
FIG. 6 is a perspective view of the channel member of FIG. 4 with door skins mounted on the channel member.

As shown in FIG. 6, door panel skins 57, 58 are fastened to the channel member 50 on each wing 51, 52. The depressions 53 are formed in the wings 51, 52 along a line in each wing 51, 52 that is located in the X direction sufficiently away from the edge of each wing 51, 52 so that the door panel skins 57, 58 can be bent around the edges of the wings 51, 52 and allow for connection of the door skins 57, 58 to the channel member 50.

It is to be appreciated that the channel member 50 may be formed from any material, such as stainless steel or aluminum, found to be suitable to those having ordinary skill in the art. The channel member 50 and the wings 51, 52 may also have a different shape configuration other than C-shaped, which is found to be suitable to those having ordinary skill in the art. The depressions 53 may also be formed with different configurations, at different sizes, and at different positions and spacing along the X, Y, and Z directions of the channel member 50 as found to be suitable to those having ordinary skill in the art. According to an alternative example of the present disclosure, the depressions 53 have a minimal pitch spacing D along the longitudinal axis Z such that the depressions 53 are formed substantially adjacent to each other.

Figure 7:
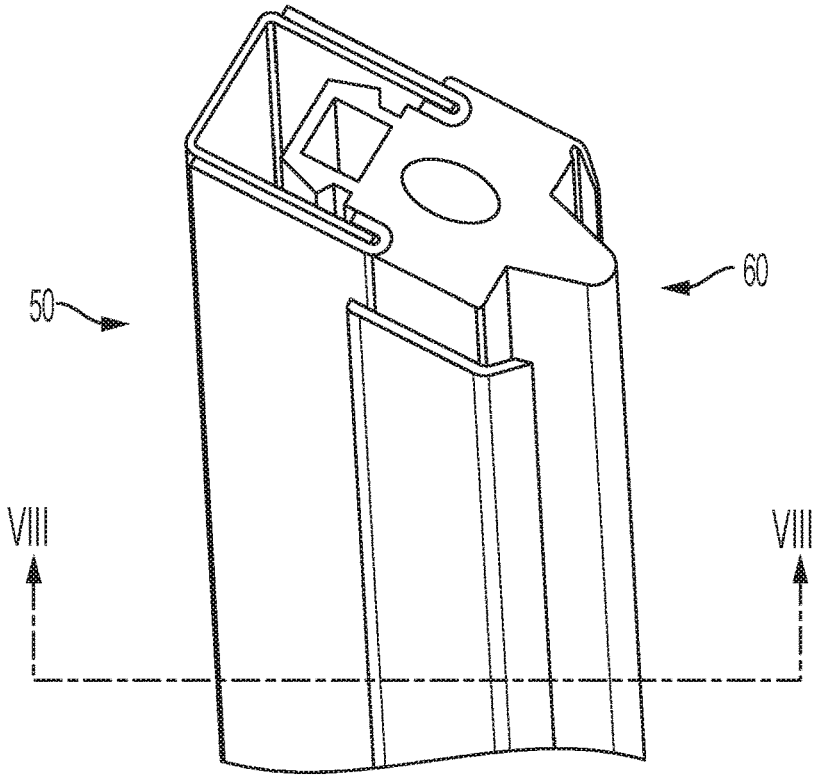
FIG. 7 is a perspective view of the sealing system with a seal member fastened to the channel member of FIG. 4 according to an example of the present disclosure.
Figure 8:
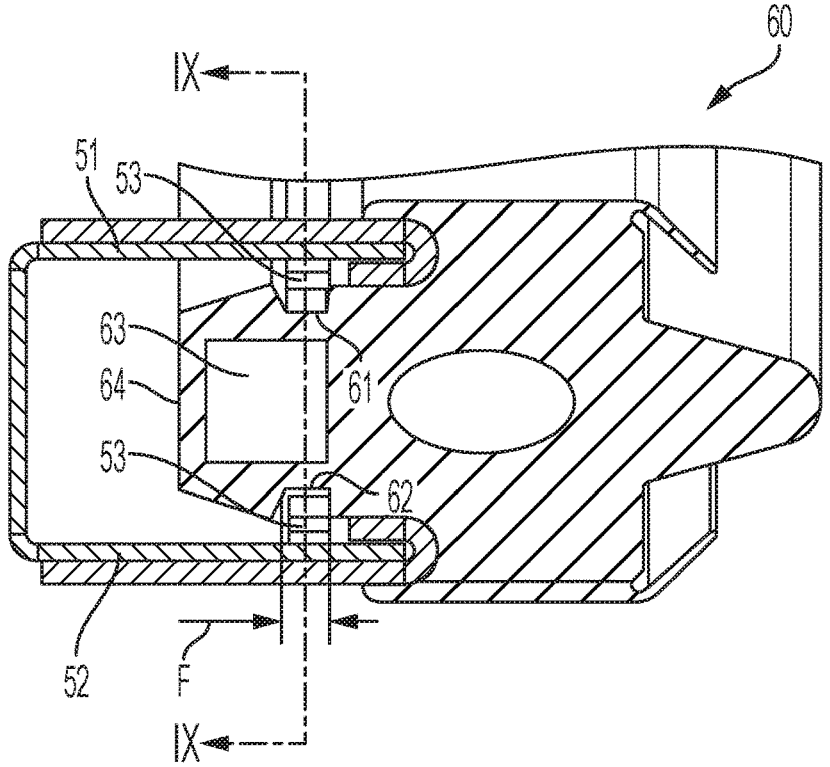
FIG. 8 is a cross-sectional view of the sealing system of FIG. 7 taken along lines VIII-VIII shown in FIG. 7.
Figure 9:
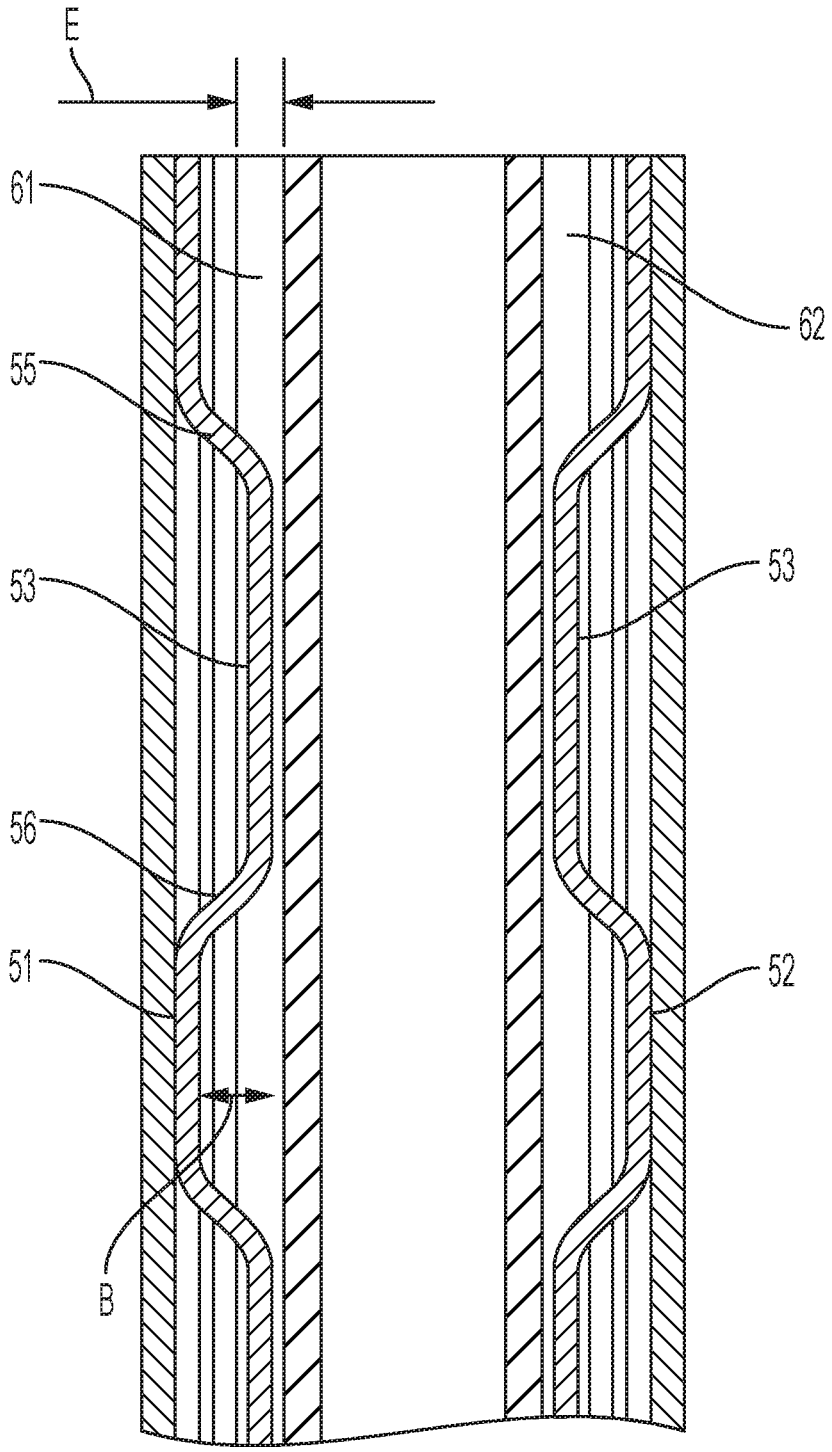
FIG. 9 is a cross-sectional view of the sealing system of FIG. 7 taken along lines IX-IX shown in FIG. 8.

As shown in FIGS. 7-9, the rubber seal member 60 is mounted on and fastened to the channel member 50 disposed on the edge of the openable panel 12 and extends along the longitudinal axis Z of the channel member 50. The seal member 60 is retained on the channel member 50 by the depressions 53 engaged within the retention grooves 61, 62 formed in the seal member 60. The seal member 60 includes a proximal portion disposed within the recess of the channel member 50 between the wings 51, 52 and a distal portion extending away from the channel member 50. The proximal portion of the seal member 60 includes a wedge profile 64 facing the bottom of the channel member 50. The seal member 60 may also have a cavity 63 defined within the wedge 64. The wedge 64 is provided to facilitate assembly of the seal member 60 on the openable panel 12 by forcing the wedge 64 into the recess of the channel member 50. This can be accomplished using a mallet or similar tool. The cavity 63 additionally facilitates insertion of the wedge 64 into the recess of the channel member 50. The retention grooves 61, 62 are defined on opposing sides of the proximal portion of the seal member 60 adjacent to the wedge 64 and extend along the longitudinal axis Z.

Each depression 53 is received within and mates with the respective retention groove 61, 62 of the seal member 60 to fasten the seal member 60 to the channel member 50. Each depression 53 is mated within the respective retention groove 61, 62 without a substantial void being formed between the depression 53 and the retention groove 61, 62 with respect to both the width F and the depth E of the retention groove 61, 62. According to a particular example of the present disclosure, the depth B and width A of each depression 53 is equal to or substantially equal to the depth E and the width F of the respective groove 61, 62 in the seal member 60.

It is to be appreciated that the seal member 60 may be formed from rubber or any other material found to be suitable to those having ordinary skill in the art. It is also to be appreciated that the seal member 60, including the wedge 64, the cavity 63, and the retention grooves 61, 62, may be formed according to any shape configuration found to be suitable to those having ordinary skill in the art. According to some examples, the proximal portion of the seal member 60 may be formed without the wedge 64, and/or the proximal portion may be formed without the cavity 63.

According to an example of the present disclosure, a method of assembling the above-described sealing system or rubber edge seal retention device is provided. A plurality of depressions 53 is formed in the side portions or wings 51, 52 of the channel member 50 by punching the wings 51, 52 inward at a plurality of locations along the longitudinal axis Z. According to a particular example, the depressions 53 are formed using a punch and die. This method provide typical dimensional tolerances of +/−0.005 inch along the X and Y directions, which are the most important axes for controlling a precise mating of the depressions 53 with the retention grooves 61, 62. Tolerance control along the Z direction is of lesser importance. It is to be appreciated that any other method and tooling that provides similar dimensional control and tolerances may be utilized in place of a punch and die system and method.

After the depressions 53 are formed in the channel member, the proximal portion of the seal member 60 is inserted into the recess of the channel member 50 such that the plurality of depressions 53 engages the retention grooves 61, 62 in the opposing sides of the seal member 60.

According to a particular example of the present disclosure, the channel member 50 and the seal member 60 can be applied to openable panels 12, 14 having curved edges so long as the radius of curvature is sufficiently large. The depressions 53 are first formed in a straight channel member 50. The channel member 50 is then bent to obtain the desired curvature profile corresponding to the curved edge of openable panels 12, 14. For openable panels 12, 14 having a profile with two sections joined by a sharp bend, the depressions 53 may be located in the Z direction so that they do not overlap with the sharp bend and so that they still substantially face each other after bending of the channel member 50.

According to another particular example of the present disclosure, a fastening means is provided at the extremities of the assembled channel member 50 and seal member 60 to further solidify the assembly and prevent unwanted disconnection of the seal member 60 from the channel member 50. Examples of such fastening means are provided in United States Patent Application Publication No. 2017/0305247.

According to the above-described examples of the present disclosure, the extraction force of the seal member 60 from the channel member 50 is important to the overall construction and functioning of the sealing system. The extraction force should be sufficiently high such that the seal member 60 cannot be pulled away from the channel member 50 by hand pulling. However, it should also be possible to remove the seal member 60 from the channel member 50 with a reasonable amount of force to allow for periodic replacement of the seal member 60. This removal of the seal member 60 can normally be accomplished by accessing the upper or lower ends of the assembled channel member 50 and seal member 60 and prying off the seal member 60 at one of the ends. Assistance can be provided by a tool inserted between the channel member 50 and the wedge 64 of the seal member 60 to facilitate initiation of the removal of the seal member 60.

According to a particular example of the present disclosure, the configuration and dimensions of the depressions 53 of the channel member 50 and the retention grooves 61, 62 of the seal member 60 are optimized to obtain an appropriate balance between an insertion force that is sufficiently low and an extraction force that is sufficiently high to prevent unwanted removal, but sufficiently low to allow for removal during regular maintenance. The main parameters controlling the insertion and extraction forces include the dimensions of the straight section 54 of each depression 53, including the width A, the length C, the depth B, and the pitch D between adjacent depressions 53. The width A and depth B should substantially correspond to the width F and depth E of the retention grooves 61, 62 of the seal member 60. The main parameters also include the duro hardness of the seal member 60, the angled shape of the wedge 64, and the shape and configuration of the cavity 63 within the wedge 64, if present. In any given example of the present disclosure, all of these parameters are selected to obtain the desired insertion and extraction forces.

According to the above-described examples, a sealing system or rubber edge seal retention device is provided that adds minimal weight to the openable panels 12, 14. The sealing system or rubber edge seal retention device has a low material and manufacturing cost. The sealing system or rubber edge seal retention device provides for easy installation of the seal member 60 on the openable panels 12, 14 and allows for calibration of the extraction force required to remove the seal member 60 from the channel member 50. The sealing system or rubber edge seal retention device provides for good control of manufacturing tolerances for repeatable retention performance. The sealing system or rubber edge seal retention device accommodates openable panels 12, 14 having curved profiles. The sealing system or rubber edge seal retention device can be used for installing the seal member 60 on the leading edges, the trailing edges, and/or the top edges.

Further examples of the present disclosure will now be described in the following numbered clauses.

Clause 1: A sealing system for an openable panel (12, 14) on a vehicle (10), comprising: a channel member (50) configured to be disposed on the openable panel (12, 14) and extending along a longitudinal axis (Z), the channel member (50) comprising at least two side portions (51, 52) extending substantially parallel to each other along the longitudinal axis (Z) and a recess defined between the at least two side portions (51, 52), and the at least two side portions (51, 52) each comprising a plurality of depressions (53) defined therein extending along the longitudinal axis (Z) and into the recess of the channel member (50), the depressions (53) arranged facing each other along the longitudinal axis (Z); and a seal member (60) fastened to the channel member (50) and extending along the longitudinal axis (Z), the seal member (60) comprising a proximal portion disposed within the recess of the channel member (50) and a distal portion extending away from the channel member (50), the proximal portion of the seal member (60) having grooves defined on opposing sides thereof extending along the longitudinal axis (Z), and the plurality of depressions (53) on each side portion (51, 52) of the channel being received in a respective groove (61, 62) on the seal member (60) to fasten the seal member (60) to the channel member (50).

Clause 2: The sealing system according to clause 1, wherein the plurality of depressions (53) is formed in the side portions (51, 52) of the channel member (50) by a punch and die.

Clause 3: The sealing system according to clause 1 or clause 2, wherein each of the plurality of depressions (53) comprises a straight section (54) extending parallel to the side portion (51, 52) and two curved sections (55, 56) connecting the straight section (54) to the side portion (51, 52).

Clause 4: The sealing system according to any one of clauses 1-3, wherein a depth (B) and width (A) of each of the plurality of depressions (53) in the channel member (50) is substantially the same as a depth (E) and width (F) of the respective groove (61, 62) in the seal member (60).

Clause 5: The sealing system according to any one of clauses 1-4, wherein the depressions (53) in each side portion (51, 52) of the channel member (50) are spaced apart along the longitudinal axis (Z).

Clause 6: The sealing system according to any one of clauses 1-5, wherein the proximal portion of the seal member (60) comprises a wedge (64).

Clause 7: The sealing system according to clause 6, wherein the wedge (64) comprises a cavity (63) defined therein to facilitate insertion of the proximal portion of the seal member (60) into the recess of the channel member (50).

Clause 8: The sealing system according to any one of clauses 1-7, wherein the plurality of depressions (53) is formed in the side portions (51, 52) of the channel member (50) at positions configured to allow for connection of door skins (57, 58) to the channel member (50).

Clause 9: The sealing system according to any one of clauses 1-8, wherein the channel member (50) is a C-shaped channel member.

Clause 10: An openable panel (12, 14) for a vehicle (10), comprising: a rigid panel configured to be movably connected to a vehicle wall (20) in an opening (18) defined in the vehicle wall (20); and a sealing system disposed on at least one side of the rigid panel (12, 14), the sealing system comprising: a channel member (50) configured to be disposed on the openable panel (12, 14) and extending along a longitudinal axis (Z), the channel member (50) comprising at least two side portions (51, 52) extending substantially parallel to each other along the longitudinal axis (Z) and a recess defined between the at least two side portions (51, 52), and the at least two side portions (51, 52) each comprising a plurality of depressions (53) defined therein extending along the longitudinal axis (Z) and into the recess of the channel member (50), the depressions (53) arranged facing each other along the longitudinal axis (Z); and a seal member (60) fastened to the channel member (50) and extending along the longitudinal axis (Z), the seal member (60) comprising a proximal portion disposed within the recess of the channel member (50) and a distal portion extending away from the channel member (50), the proximal portion of the seal member (60) having grooves defined on opposing sides thereof extending along the longitudinal axis (Z), and the plurality of depressions (53) on each side portion (51, 52) of the channel being received in a respective groove (61, 62) on the seal member (60) to fasten the seal member (60) to the channel member (50).

Clause 11: The openable panel (12, 14) according to clause 10, wherein the rigid panel comprises a vehicle door panel.

Clause 12: The openable panel (12, 14) according to clause 10 or clause 11, wherein each of the plurality of depressions (53) comprises a straight section (54) extending parallel to the side portion (51, 52) and two curved sections (55, 56) connecting the straight section (54) to the side portion (51, 52).

Clause 13: The openable panel (12, 14) according to any one of clauses 10-12, wherein a depth (B) and width (A) of each of the plurality of depressions (53) in the channel member is substantially the same as a depth (E) and width (F) of the respective groove (61, 62) in the seal member (60).

Clause 14: The openable panel (12, 14) according to any one of clauses 10-13, wherein the depressions (53) in each side portion (51, 52) of the channel member (50) are spaced apart along the longitudinal axis (Z).

Clause 15: The openable panel (12, 14) according to any one of clauses 10-15, wherein the proximal portion of the seal member (60) comprises a wedge (64).

Clause 16: The openable panel (12, 14) according to clause 15, wherein the wedge (64) comprises a cavity (63) defined therein to facilitate insertion of the proximal portion of the seal member (60) into the recess of the channel member (50).

Clause 17: The openable panel (12, 14) according to any one of clauses 10-16, wherein the channel member (50) is a C-shaped channel member.

Clause 18: A method for assembling the sealing system according any one of clauses 1-9, comprising: providing the channel member (50); forming the plurality of depressions (53) in the side portions (51, 52) of the channel member (50) by punching inward the side portions (51, 52) of the channel member (50) at a plurality of locations along the longitudinal axis (Z); and inserting the proximal portion of the seal member (60) into the recess of the channel member (50) such that the plurality of depressions (53) engages the grooves (61, 62) in the opposing sides of the seal member (60).

Clause 19: The method according to clause 18, further comprising bending the channel member (50) to obtain a curvature corresponding to a curved edge of the openable panel (12, 14).

Clause 20: The method according to clause 18 or clause 19, wherein the depressions (53) are formed with a width (A) and depth (B) equal to a width (F) and depth (E) of the grooves (61, 62) in the seal member (60).

It is to be understood that the invention may assume various alternative variations and step sequences, except where expressly specified to the contrary. It is also to be understood that the specific devices and processes illustrated in the attached drawings and described in the specification are simply exemplary embodiments or aspects of the invention. Although the invention has been described in detail for the purpose of illustration based on what is currently considered to be the most practical and preferred embodiments or aspects, it is to be understood that such detail is solely for that purpose and that the invention is not limited to the disclosed embodiments or aspects, but on the contrary is intended to cover modifications and equivalent arrangements that are within the spirit and scope thereof. For example, it is to be understood that the present invention contemplates that to the extent possible, one or more features of any embodiment or aspect can be combined with one or more features of any other embodiment or aspect.

The invention claimed is:

1. A sealing system for an openable panel on a vehicle, the sealing system comprising:

a channel member configured to be disposed on the openable panel and extending along a longitudinal axis, the channel member comprising side portions extending substantially parallel to each other along the longitudinal axis and a recess defined between the side portions, the side portions each comprising a plurality of depressions defined therein extending along the longitudinal axis and into the recess of the channel member, the depressions arranged facing each other along the longitudinal axis; and a seal member fastened to the channel member and extending along the longitudinal axis, the seal member comprising a proximal portion disposed within the recess of the channel member and a distal portion extending away from the channel member, the proximal portion of the seal member having grooves defined on opposite sides of the proximal portion and extending along the longitudinal axis, and the depressions on each of the side portions of the channel being received in corresponding grooves on the seal member to fasten the seal member to the channel member.

2. The sealing system according to claim 1, wherein the plurality of depressions is formed in the side portions of the channel member by a punch and die.

3. The sealing system according to claim 1, wherein each of the depressions comprises a straight section extending parallel to the side portion and two curved sections connecting the straight section to the side portion.

4. The sealing system according to claim 1, wherein a depth and width of each of the depressions in the channel member is substantially the same as a depth and width of the respective groove in the seal member.

5. The sealing system according to claim 1, wherein the depressions in each of the side portions of the channel member are spaced apart along the longitudinal axis.

6. The sealing system according to claim 1, wherein the proximal portion of the seal member comprises a wedge.

7. The sealing system according to claim 6, wherein the wedge comprises a cavity defined therein to facilitate insertion of the proximal portion of the seal member into the recess of the channel member.

8. The sealing system according to claim 1, wherein the plurality of depressions is formed in the side portions of the channel member at positions configured to allow for connection of door skins to the channel member.

9. The sealing system according to claim 1, wherein the channel member is a C-shaped channel member.

10. An openable panel for a vehicle, the panel comprising:

a rigid panel configured to be movably connected to a vehicle wall in an opening defined in the vehicle wall; and a sealing system disposed on at least one side of the rigid panel, the sealing system comprising:

a channel member connected to the at least one side of the rigid panel and extending along a longitudinal axis, the channel member comprising side portions extending substantially parallel to each other along the longitudinal axis and a recess defined between the side portions, and each of the side portions comprising a plurality of depressions defined therein extending along the longitudinal axis and into the recess of the channel member, the depressions arranged facing each other along the longitudinal axis; and a seal member fastened to the channel member and extending along the longitudinal axis, the seal member comprising a proximal portion disposed within the recess of the channel member and a distal portion extending away from the channel member, the proximal portion of the seal member having grooves defined on opposite sides of the proximal portion and extending along the longitudinal axis, the depressions on each of the side portions of the channel being received in corresponding grooves on the seal member to fasten the seal member to the channel member.

11. The openable panel according to claim 10, wherein the rigid panel comprises a vehicle door panel.

12. The openable panel according to claim 10, wherein each of the depressions comprises a straight section extending parallel to one of the side portions and curved sections connecting the straight section to the one of the side portions.

13. The openable panel according to claim 10, wherein a depth and width of each of the depressions in the channel member is substantially the same as a depth and width of the respective groove in the seal member.

14. The openable panel according to claim 10, wherein the depressions in each of the side portions of the channel member are spaced apart along the longitudinal axis.

15. The openable panel according to claim 10, wherein the proximal portion of the seal member comprises a wedge.

16. The openable panel according to claim 15, wherein the wedge comprises a cavity defined therein to facilitate insertion of the proximal portion of the seal member into the recess of the channel member.

17. The openable panel according to claim 10, wherein the channel member is a C-shaped channel member.

18. A method for assembling the sealing system according to claim 1, the method comprising:

providing the channel member;

forming the plurality of depressions in the side portions of the channel member by inwardly punching the side portions of the channel member at a plurality of locations along the longitudinal axis; and inserting the proximal portion of the seal member into the recess of the channel member such that the plurality of depressions engages the grooves in the opposite sides of the seal member.

19. The method according to claim 18, further comprising bending the channel member to obtain a curvature corresponding to a curved edge of the openable panel.

20. The method according to claim 18, wherein the depressions are formed with a width and depth equal to a width and depth of the grooves in the seal member.

* * * * *